US008800184B1

(12) United States Patent
Lerman et al.

(10) Patent No.: US 8,800,184 B1
(45) Date of Patent: Aug. 12, 2014

(54) MOUTH GUARD SYSTEM

(71) Applicants: Roy Lerman, Old Bridge, NJ (US); Frank DeLeo, Moonachie, NJ (US); Edward Jasinski, Manchester, NJ (US); Steven Jasinski, Manchester, NJ (US)

(72) Inventors: Roy Lerman, Old Bridge, NJ (US); Frank DeLeo, Moonachie, NJ (US); Edward Jasinski, Manchester, NJ (US); Steven Jasinski, Manchester, NJ (US)

( * ) Notice: Subject to any disclaimer, the term of this patent is extended or adjusted under 35 U.S.C. 154(b) by 0 days.

(21) Appl. No.: 13/972,295

(22) Filed: Aug. 21, 2013

(51) Int. Cl.
*A61C 13/08* (2006.01)
*A63B 71/08* (2006.01)
*A44C 15/00* (2006.01)

(52) U.S. Cl.
CPC ..... *A63B 71/085* (2013.01); *A44C 15/007* (2013.01)
USPC ..... 40/586; 433/168.1; 433/215; 128/861; 128/862; D29/108

(58) Field of Classification Search
CPC ..... A61C 13/0001; A61C 5/00; A61C 5/08; A61C 5/02; A61C 19/066; A61K 6/083; A63B 71/08; A63B 71/085; A44C 15/007
USPC ..... D11/3, 4, 6, 19; 63/21, 40; 40/586, 665, 40/633; 128/861, 862; 433/167, 168.1, 433/215, 218, 619; D29/108
See application file for complete search history.

(56) References Cited

U.S. PATENT DOCUMENTS

| | | | | |
|---|---|---|---|---|
| 5,759,039 | A | 6/1998 | Kunstadter et al. | |
| 5,782,638 | A | 7/1998 | Warren, III et al. | |
| 5,916,653 | A | 6/1999 | Kunstadter et al. | |
| 6,089,870 | A | 7/2000 | Deroo | |
| 6,321,752 | B1 * | 11/2001 | Spottiswoode | 128/859 |
| 6,494,210 | B1 | 12/2002 | Mams | |
| D497,826 | S * | 11/2004 | Nelson | D11/3 |
| 6,997,712 | B2 | 2/2006 | Kim | |
| D523,994 | S | 6/2006 | Manzo | |
| 7,980,249 | B2 | 7/2011 | Landi et al. | |
| D655,458 | S * | 3/2012 | Badger et al. | D29/108 |
| D693,966 | S * | 11/2013 | Hanson | D29/108 |
| 2003/0211324 | A1 | 11/2003 | Brinkman | |
| 2004/0076219 | A1 * | 4/2004 | Madison et al. | 374/159 |
| 2007/0059667 | A1 * | 3/2007 | Lim | 433/219 |
| 2008/0003541 | A1 * | 1/2008 | Leslie-Martin | 433/215 |
| 2008/0076093 | A1 * | 3/2008 | Kim et al. | 433/206 |
| 2008/0120878 | A1 * | 5/2008 | Smith | 40/586 |
| 2011/0297165 | A1 * | 12/2011 | Wang | 128/861 |

* cited by examiner

*Primary Examiner* — Casandra Davis

(57) ABSTRACT

A mouth guard system for displaying a message using interchangeable tiles resembling teeth features an upper mouth guard. A plurality of tile channels, tile openings, and tile insertion apertures is located in the upper mouth guard. The system features a lower mouth guard. A plurality of tile channels, tile openings, and tile insertion apertures is located in the upper mouth guard. Each tile opening features a shape resembling a tooth. The system features a plurality of tiles designed to snuggly slide into the tile channel via the tile insertion aperture. The tile is visible via the tile opening. A tile cutout of a symbol, a character, or a picture is located throughout a cross-section of the tile from a tile front surface to a tile rear surface. A back wall of the tile channel is visible through the tile cutout. Each tile features rounded edges and rounded corners.

8 Claims, 4 Drawing Sheets

MOUTH GUARD SYSTEM

FIELD OF THE INVENTION

The present invention relates to mouth guards, or more specifically, mouth guards that are used to display a message. In some embodiments, the teeth guard is transparent so when the tiles are inserted they will look like teeth in a mouth, and in some embodiments, the teeth guard can glow in the dark.

BACKGROUND OF THE INVENTION

Mouth guards have been used for many years to protect a user's teeth from impact during a sporting activity. They are also used to encourage correct teeth alignment when braces have been removed from an orthodontic patient. The present invention features a mouth guard system for displaying a message using interchangeable tiles resembling teeth.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a mouth guard system for displaying a message using interchangeable tiles resembling teeth. In some embodiments, the system comprises an upper mouth guard. In some embodiments, the upper mouth guard comprises a shape of a "U" in a transverse plane. In some embodiments, a plurality of tile channels is sequentially located in the upper mouth guard. In some embodiments, a plurality of tile openings, each fluidly connected to a corresponding tile channel, is located on an upper mouth guard front surface. In some embodiments, a plurality of tile insertion apertures, each fluidly connected to a corresponding tile channel, is located on an upper mouth guard top surface next to the mouth guard front surface. In some embodiments, the tile opening comprises a shape resembling a tooth.

In some embodiments, the system comprises a lower mouth guard. In some embodiments, the lower mouth guard comprises a shape of a "U" in a transverse plane. In some embodiments, a plurality of tile channels is sequentially located in the lower mouth guard. In some embodiments, a plurality of tile openings, each fluidly connected to a corresponding tile channel, is located on a lower mouth guard front surface. In some embodiments, a plurality of tile insertion apertures, each fluidly connected to a corresponding tile channel, is located on a lower mouth guard bottom surface next to the mouth guard front surface. In some embodiments, the tile opening comprises a shape resembling a tooth.

In some embodiments, the system comprises a plurality of tiles. In some embodiments, the tile is designed to snuggly slide into the tile channel via the tile insertion aperture. In some embodiments, the tile is visible via the tile opening. In some embodiments, a tile cutout of a symbol, a character, or a picture is located throughout a cross-section of the tile from a tile front surface to a tile rear surface. In some embodiments, a back wall of the tile channel is visible through the tile cutout. In some embodiments, each tile comprises rounded edges and rounded corners.

DESCRIPTION OF PREFERRED EMBODIMENTS

Figure 1:
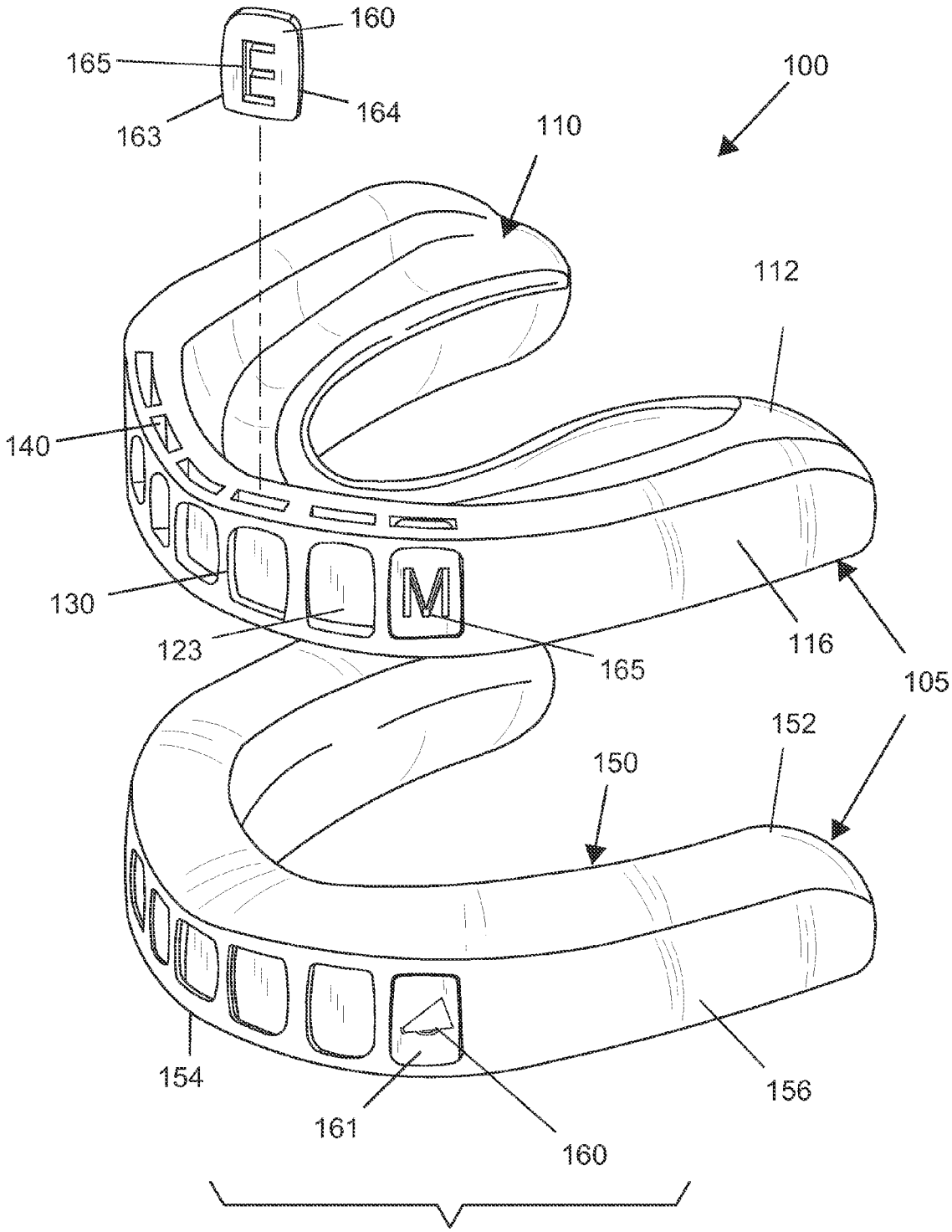
FIG. 1 shows a perspective view of the present invention.
Figure 2:
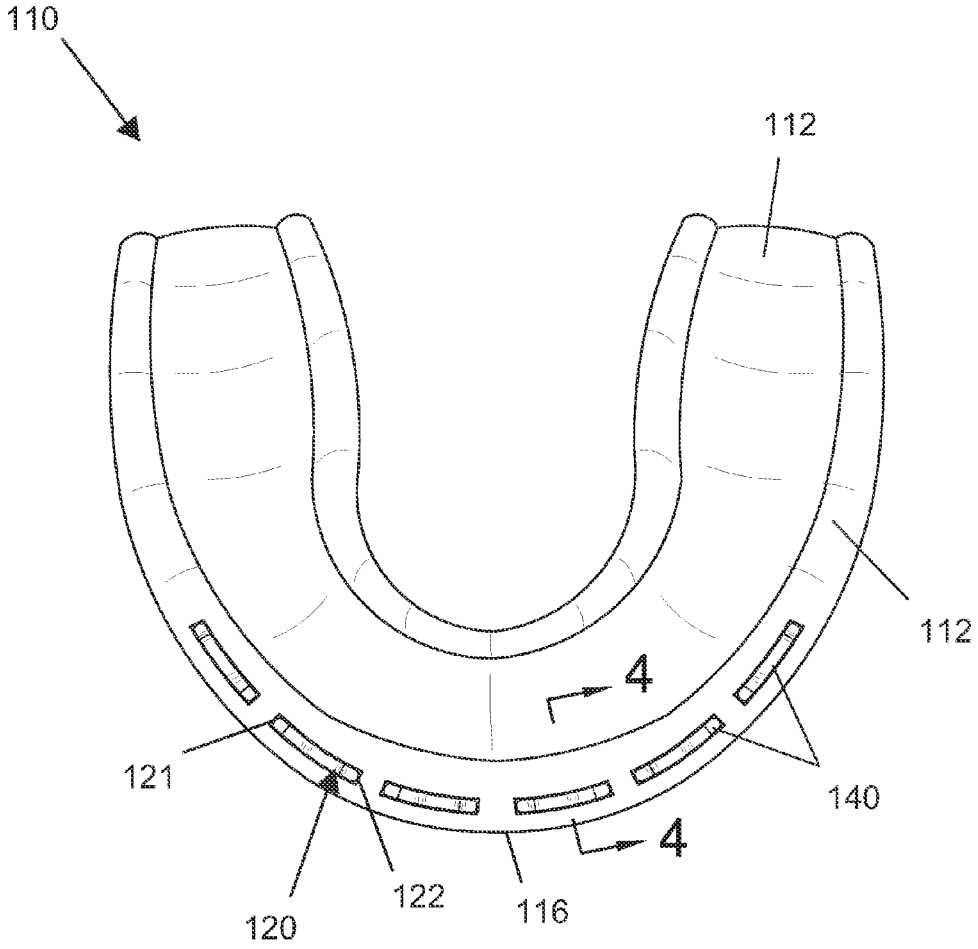
FIG. 2 shows a top view of the upper mouth guard of the present invention.
Figure 3:
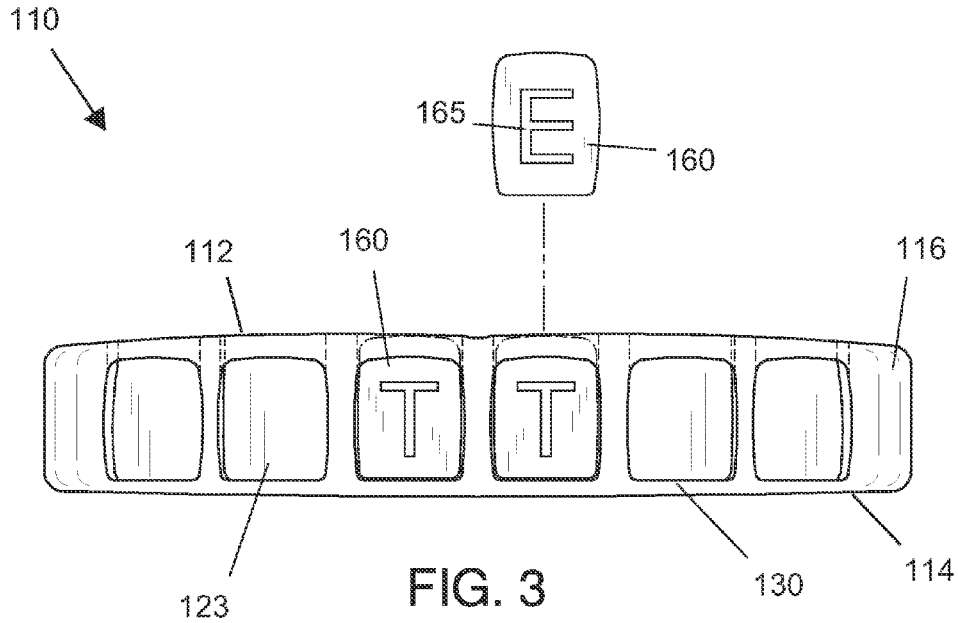
FIG. 3 shows a front view of the upper mouth guard of the present invention.
Figure 4:
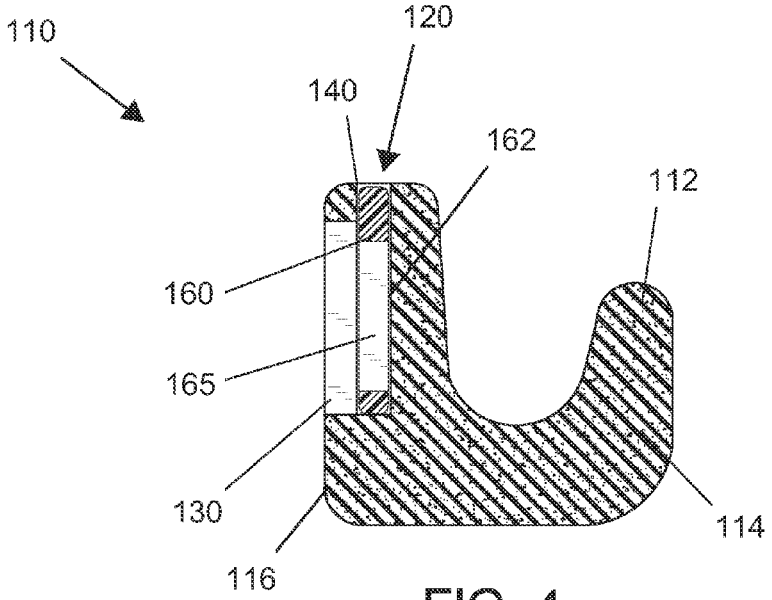
FIG. 4 shows a cross-sectional view of the upper mouth guard of the present invention in a sagittal plane.
Figure 5:
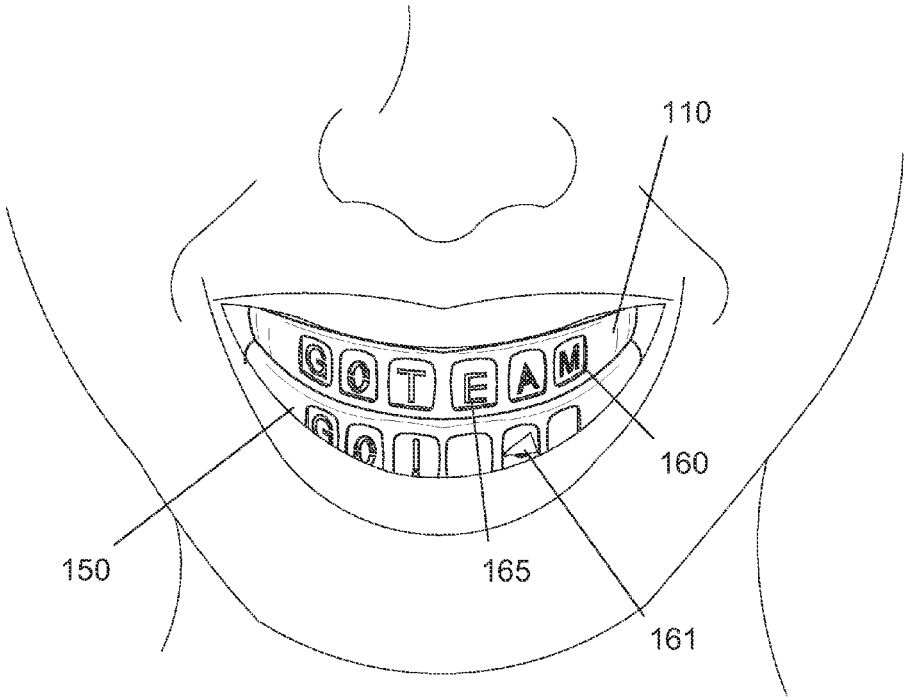
FIG. 5 shows a front view of the present invention in use.

Following is a list of elements corresponding to a particular element referred to herein:

100 Mouth guard system
105 Mouth guard
110 Upper mouth guard
112 Upper mouth guard top surface
114 Upper mouth guard bottom surface
116 Upper mouth guard front surface
120 Tile channel
121 Tile channel first edge
122 Tile channel second edge
123 Tile channel back wall
130 Tile opening
140 Tile insertion aperture
150 Lower mouth guard
152 Lower mouth guard top surface
154 Lower mouth guard bottom surface
156 Lower mouth guard front surface
160 Tile
161 Tile front surface
162 Tile rear surface
163 Tile first edge
164 Tile second edge
165 Tile cutout Referring now to FIGS. 1-5, the present invention features a mouth guard system (100) for displaying a message using interchangeable tiles resembling teeth. In some embodiments, the system (100) comprises an upper mouth guard (110) having an upper mouth guard top surface (112), an upper mouth guard bottom surface (114), and an upper mouth guard front surface (116). In some embodiments, the upper mouth guard (110) comprises a shape of a "U" in a transverse plane.

In some embodiments, a plurality of tile channels (120) is sequentially located in the upper mouth guard (110). In some embodiments, a plurality of tile openings (130), each fluidly connected to a corresponding tile channel (120), is located on an upper mouth guard front surface (116) thereon. In some embodiments, the tile opening (130) comprises a smaller opening than the tile channel (120) thereby forming a retaining lip around the opening. In some embodiments, a plurality of tile insertion apertures (140), each fluidly connected to a corresponding tile channel (120), is located on an upper mouth guard top surface (112) thereon adjacent to the upper mouth guard front surface (116). In some embodiments, the tile opening (130) comprises a shape resembling a tooth.

In some embodiments, the system (100) comprises a lower mouth guard (150) having a lower mouth guard top surface (152), a lower mouth guard bottom surface (154), and a lower mouth guard front surface (156). In some embodiments, the lower mouth guard (150) comprises a shape of a "U" in a transverse plane.

In some embodiments, a plurality of tile channels (120) is sequentially located in the lower mouth guard (150). In some embodiments, a plurality of tile openings (130), each fluidly connected to a corresponding tile channel (120), is located on a lower mouth guard front surface (156) thereon. In some embodiments, the tile opening (130) comprises a smaller opening than the tile channel (120) thereby forming a retaining lip around the opening. In some embodiments, a plurality of tile insertion apertures (140), each fluidly connected to a corresponding tile channel (120), is located on a lower mouth guard bottom surface (154) thereon adjacent to the lower mouth guard front surface (156). In some embodiments, the tile opening (130) comprises a shape resembling a tooth.

In some embodiments, the upper mouth guard (110) and the lower mouth guard (150) are collectively hereinafter known as a mouth guard (105). In some embodiments, the mouth guard (150) is a sporting mouth guard. In some embodiments, the mouth guard (150) is a dental retainer.

In some embodiments, the system (100) comprises a plurality of tiles (160), each having a tile front surface (161) and a tile rear surface (162). In some embodiments, the tile (160) is designed to snuggly slide into the tile channel (120) via the tile insertion aperture (140). In some embodiments, the tile (160) is visible via the opening (130). In some embodiments, a tile cutout (165) of a symbol, a character, or a picture is located throughout a cross-section of the tile (160) from the tile front surface (161) to the rear surface (162). In some embodiments, a tile channel back wall (123) is visible through tile cutout (165). In some embodiments, each tile (160) comprises rounded edges. In some embodiments, each tile (160) comprises rounded corners.

In some embodiments, a plurality of tiles is inserted into the mouth guards (105) via the tile insertion apertures (140) for displaying a message.

In some embodiments, the mouth guard (105) is constructed from a plastic that contains phosphor. In some embodiments, the mouth guard (105) comprises glow-in-the-dark properties.

In some embodiments, the tile (160) is constructed from a plastic that contains phosphor. In some embodiments, the tile (160) comprises glow-in-the-dark properties.

In some embodiments, the system comprises an additional tile (160) having no tile cutout (165). In some embodiments, the system comprises an additional tile (160) having a symbol, a character, or a picture located on a tile front surface (161) thereon. In some embodiments, the symbol, the character, or the picture is printed or inscribed on the tile front surface (161).

In some embodiments, the tile (160) comprises a shape of a curve from a tile first edge (163) to a tile second edge (164) resembling a curvature of the mouth guard (105). In some embodiments, the tile channel (120) comprises a curve from a tile channel first edge (121) to a tile channel second edge (122) resembling the curvature of the mouth guard (105).

In some embodiments, the mouth guard (105) comprises 6 tile cutouts (165). In some embodiments, the mouth guard (105) comprises 4 tile cutouts (165). In some embodiments, the mouth guard (105) comprises 5 tile cutouts (165). In some embodiments, the mouth guard (105) comprises 7 tile cutouts (165). In some embodiments, the mouth guard (105) comprises 8 tile cutouts (165). In some embodiments, the mouth guard (105) comprises 9 tile cutouts (165). In some embodiments, the mouth guard (105) comprises 10 tile cutouts (165).

As used herein, the term "about" refers to plus or minus 10% of the referenced number.

The disclosures of the following U.S. patents are incorporated in their entirety by reference herein: U.S. Pat. No. D 523,994; U.S. Patent Pub. No. 2008/0003541; U.S. Pat. No. 7,980,249; U.S. Pat. No. 6,997,712; U.S. Pat. No. 6,494,210; U.S. Pat. No. 6,089,870; U.S. Pat. No. 5,916,653; U.S. Pat. No. 5,782,638; and U.S. Pat. No. 5,759,039.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A mouth guard system (100) for displaying a message using interchangeable tiles resembling teeth, wherein the system (100) comprises:

(a) an upper mouth guard (110) having an upper mouth guard top surface (112), an upper mouth guard bottom surface (114), and an upper mouth guard front surface (116), wherein the upper mouth guard (110) comprises a shape of a "U" in a transverse plane, wherein a plurality of upper tile channels (120) is sequentially disposed in the upper mouth guard (110), wherein a plurality of upper tile openings (130), each fluidly connected to a corresponding upper tile channel (120), is disposed on the upper mouth guard front surface (116) thereon, wherein the upper tile opening (130) comprises a smaller opening than the upper tile channel (120), wherein a plurality of upper tile insertion apertures (140), each fluidly connected to a corresponding upper tile channel (120), is disposed on the upper mouth guard top surface (112) thereon adjacent to the upper mouth guard front surface (116), wherein the tile upper opening (130) comprises a shape resembling a tooth;

(b) a lower mouth guard (150) having a lower mouth guard top surface (152), a lower mouth guard bottom surface (154), and a lower mouth guard front surface (156), wherein the lower mouth guard (150) comprises a shape of a "U" in a transverse plane, wherein a plurality of lower tile channels (120) is sequentially disposed in the lower mouth guard (150), wherein a plurality of lower tile openings (130), each fluidly connected to a corresponding lower tile channel (120), is disposed on the lower mouth guard front surface (156)

thereon, wherein the lower tile opening (130) comprises a smaller opening than the lower tile channel (120), wherein a plurality of lower tile insertion apertures (140), each fluidly connected to a corresponding lower tile channel (120), is disposed on the lower mouth guard bottom surface (154) thereon adjacent to the lower mouth guard front surface (156), wherein the lower tile opening (130) comprises a shape resembling a tooth, wherein the upper mouth guard (110) and the lower mouth guard (150) are collectively hereinafter known as a mouth guard (105); and (c) a plurality of tiles (160), each having a tile front surface (161) and a tile rear surface (162), wherein the tile (160) is designed to snuggly slide into the tile channel (120) via the tile insertion aperture (140), wherein the tile (160) is visible via the tile opening (130), wherein a tile cutout (165) of a symbol, a character, or a picture is disposed throughout a cross-section of the tile (160) from the tile front surface (161) to the tile rear surface (162), wherein a tile channel back wall (123) is visible through the tile cutout (165), wherein each tile (160) comprises rounded edges, wherein each tile (160) comprises rounded corners, wherein a plurality of tiles is inserted into the mouth guards (105) via the tile insertion apertures (140) for displaying a message.

2. The system (100) of claim 1, wherein the mouth guard (105) is constructed from a plastic that contains phosphor, wherein the mouth guard (105) comprises glow-in-the-dark properties.

3. The system (100) of claim 1, wherein the tile (160) is constructed from a plastic that contains phosphor, wherein the tile (160) comprises glow-in-the-dark properties.

4. The system (100) of claim 1, comprising an additional tile (160) having no tile cutout (165).

5. The system (100) of claim 4, comprising an additional tile (160) having a symbol, a character, or a picture disposed on the tile front surface (161) thereon.

6. The system (100) of claim 1, wherein the tile (160) comprises a shape of a curve from a tile first edge (163) to a tile second edge (164) resembling a curvature of the mouth guard (105).

7. The system (100) of claim 6, wherein the tile channel (120) comprises a curve from a tile channel first edge (121) to a tile channel second edge (122) resembling the curvature of the mouth guard (105).

8. The system (100) of claim 1, wherein the mouth guard (105) comprises 6 tile cutouts (165).

* * * * *